US009609989B2

(12) United States Patent
Lee et al.

(10) Patent No.: US 9,609,989 B2
(45) Date of Patent: Apr. 4, 2017

(54) VACUUM CLEANER FOR BEDDING

(75) Inventors: Changook Lee, Changwon-si (KR); Changdo Park, Changwon-si (KR); Taekyung Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 212 days.

(21) Appl. No.: 13/330,864

(22) Filed: Dec. 20, 2011

(65) Prior Publication Data

US 2012/0151711 A1 Jun. 21, 2012

(30) Foreign Application Priority Data

Dec. 21, 2010 (KR) ..... 10-2010-0131161

(51) Int. Cl.

| | |
|---|---|
| ***A47L 5/24*** | (2006.01) |
| ***A47L 7/00*** | (2006.01) |
| ***A47L 9/14*** | (2006.01) |

(52) U.S. Cl.

CPC ..... *A47L 9/1481* (2013.01); *A47L 5/24* (2013.01); *A47L 7/008* (2013.01)

(58) Field of Classification Search

CPC .. A47L 9/00; A47L 11/24; A47L 11/33; A47L 5/00; A47L 11/00; A47L 11/32; A46B 13/04

USPC ..... 15/347, 52.1, 41.1, 42, 83

See application file for complete search history.

(56) References Cited

U.S. PATENT DOCUMENTS

| | | | | |
|---|---|---|---|---|
| 3,654,661 | A * | 4/1972 | Scott | 15/333 |
| 4,748,713 | A * | 6/1988 | Sepke | A47L 5/30 15/347 |
| 6,532,620 | B2 * | 3/2003 | Oh | 15/353 |
| 7,861,351 | B2 * | 1/2011 | Ho | A47L 11/33 15/41.1 |
| 2004/0134025 | A1 * | 7/2004 | Murphy et al. | 15/403 |
| 2007/0251048 | A1 | 11/2007 | Choi | 15/329 |
| 2009/0144932 | A1 * | 6/2009 | Yoo | A47L 5/22 15/347 |
| 2010/0132319 | A1 * | 6/2010 | Ashbee et al. | 55/429 |

(Continued)

FOREIGN PATENT DOCUMENTS

| | | |
|---|---|---|
| EP | 1 547 509 A2 | 6/2005 |
| KR | 10-2001-0084829 | 9/2001 |

(Continued)

OTHER PUBLICATIONS

European Search Report dated Mar. 30, 2012 issued in Application No. 11 19 4535.

(Continued)

*Primary Examiner* — Monica Carter

*Assistant Examiner* — Stephanie Berry

(74) *Attorney, Agent, or Firm* — Ked & Associates LLP

(57) ABSTRACT

Provided is a vacuum cleaner for bedding. The vacuum cleaner for bedding includes a casing defining an outer appearance, a dust movement device moving dust into the casing, a dust collection member disposed accessible into the casing, the dust collection member collecting the dust moved into the casing by the dust movement device, a drawing device drawing the dust collection member received in the casing to the outside of the casing, and a locking device preventing the drawing device from be voluntarily moved in a direction in which the dust collection member is drawn to the outside of the casing.

9 Claims, 10 Drawing Sheets

(56) References Cited

U.S. PATENT DOCUMENTS

| | | | | |
|---|---|---|---|---|
| 2011/0138568 | A1* | 6/2011 | Hsu | 15/339 |
| 2012/0102670 | A1* | 5/2012 | Jang et al. | 15/347 |

FOREIGN PATENT DOCUMENTS

| | | | |
|---|---|---|---|
| KR | 10-0648961 | B1 | 11/2006 |
| KR | 20-0441748 | | 8/2008 |

OTHER PUBLICATIONS

Korean Office Action dated Jun. 18, 2012 issued in Application No. 10-2010-0131161.
Korean Notice of Allowance dated Oct. 24, 2012.

* cited by examiner

VACUUM CLEANER FOR BEDDING

CROSS-REFERENCE TO RELATED APPLICATIONS

The present application claims priority under 35 U.S.C. 119 and 35 U.S.C. 365 to Korean Patent Application No. 10-2010-0131161 (filed on Dec. 21, 2010), which is hereby incorporated by reference in its entirety.

BACKGROUND

The present disclosure relates to a vacuum cleaner for bedding.

Generally, vacuum cleaners remove foreign substances using a suction force by a suction device or an adhesive force of a member such as a brush. Such a cleaner includes a dust collection member for collecting removed dust. Also, the collection member may be accessibly disposed on the vacuum cleaner to empty the dust collected therein.

SUMMARY

Embodiments provide a vacuum cleaner for bedding in which a dust collection member is more easily accessible.

In one embodiment, a cleaner includes: a casing defining an outer appearance; a dust movement device moving dust into the casing; a dust collection member disposed accessible into the casing, the dust collection member collecting the dust moved into the casing by the dust movement device; a drawing device drawing the dust collection member received in the casing to the outside of the casing; and a locking device preventing the drawing device from being voluntarily moved in a direction in which the dust collection member is drawn to the outside of the casing.

In another embodiment, a cleaner includes: a casing having a suction hole for sucking dust, the casing including a receiving member defining a receiving space; a suction device sucking air containing the dust through the suction hole; a punching member punching an object to be cleaned to suck the dust using the suction device; a dust collection member disposed accessible into the receiving space, the dust collection member collecting the dust sucked into the casing by the suction device; a drawing member movably disposed in a linear direction with respect to the receiving member to draw the dust collection member to the outside of the receiving space so that at least one portion of the dust collection member is drawn to the outside of the casing; a support member fixed to the receiving member to support the drawing member so that the drawing member is movable in the linear direction with respect to the receiving member; an elastic member applying an elastic force to the drawing member in a direction in which the dust collection member is drawn to the outside of the receiving space; and a locking device selectively allowing a linear movement of the drawing member with respect to the receiving space.

The details of one or more embodiments are set forth in the accompanying drawings and the description below. Other features will be apparent from the description and drawings, and from the claims.

DETAILED DESCRIPTION OF THE EMBODIMENTS

Hereinafter, a vacuum cleaner for bedding according to a first embodiment will be described in detail with reference to the accompanying drawings.

Figure 1:
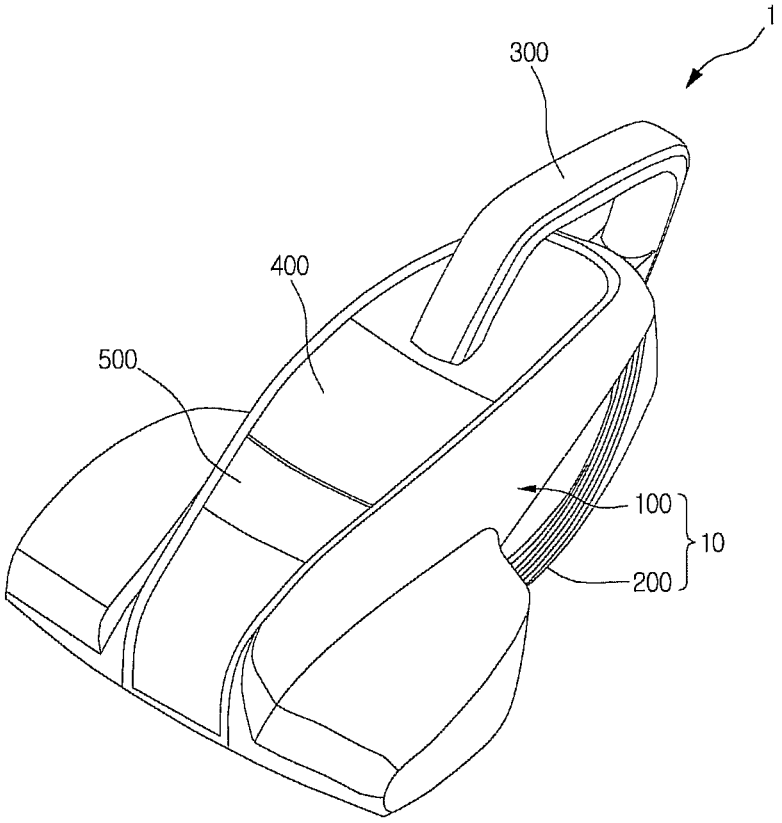
FIG. 1 is a perspective view of a vacuum cleaner for bedding according to a first embodiment.
Figure 2:
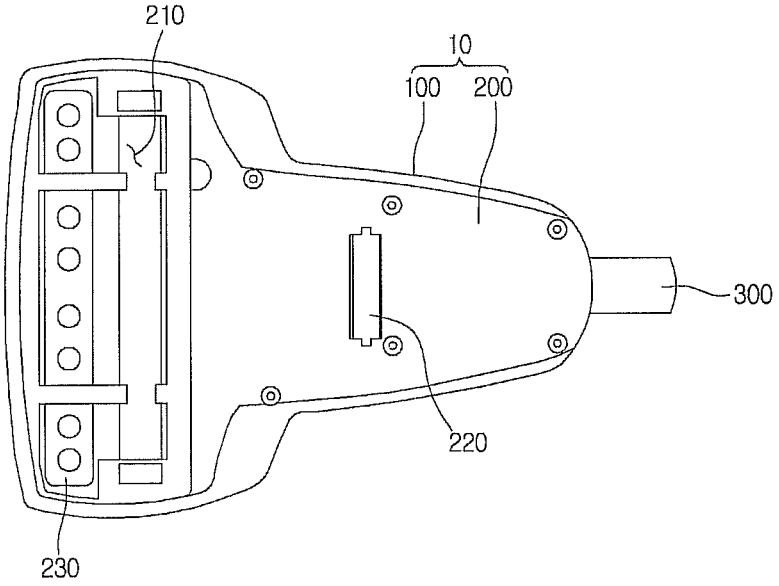
FIG. 2 is a bottom view of the vacuum cleaner for bedding according to the first embodiment.
Figure 3:
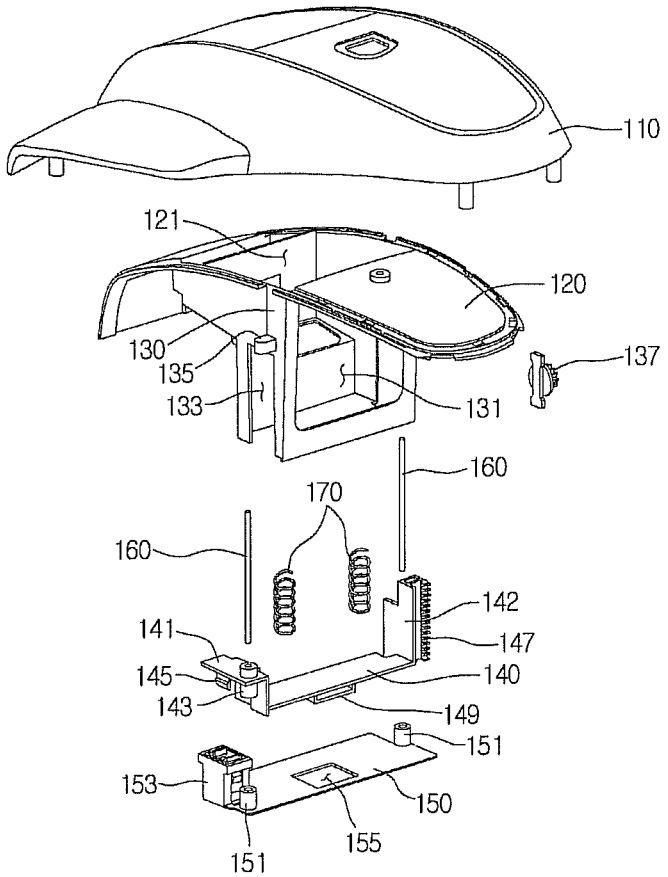
FIG. 3 is an exploded perspective view illustrating a main part of the vacuum cleaner for bedding according to the first embodiment.
Figure 4:
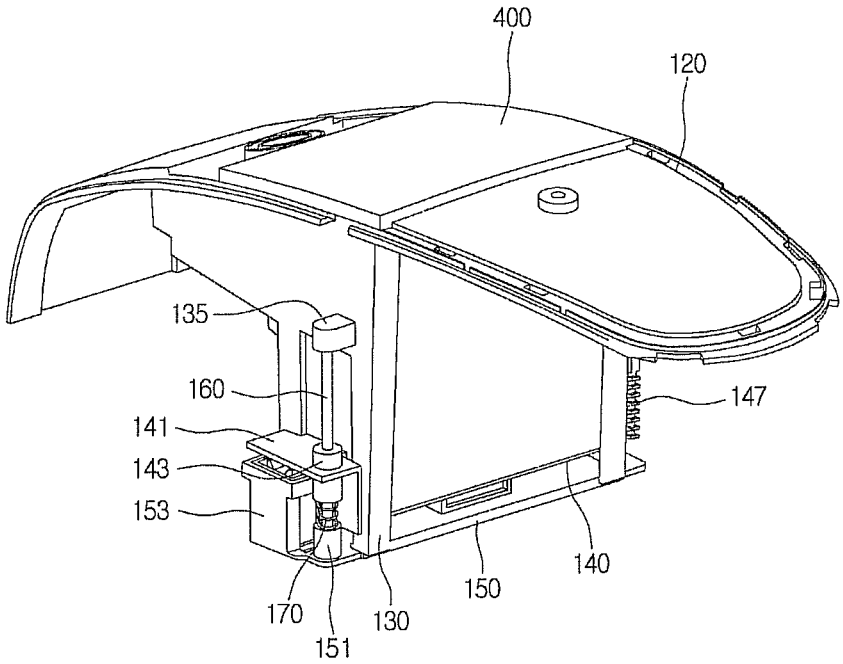
FIG. 4 is a perspective view illustrating a main part of the vacuum cleaner for bedding according to the first embodiment.
Figure 5:
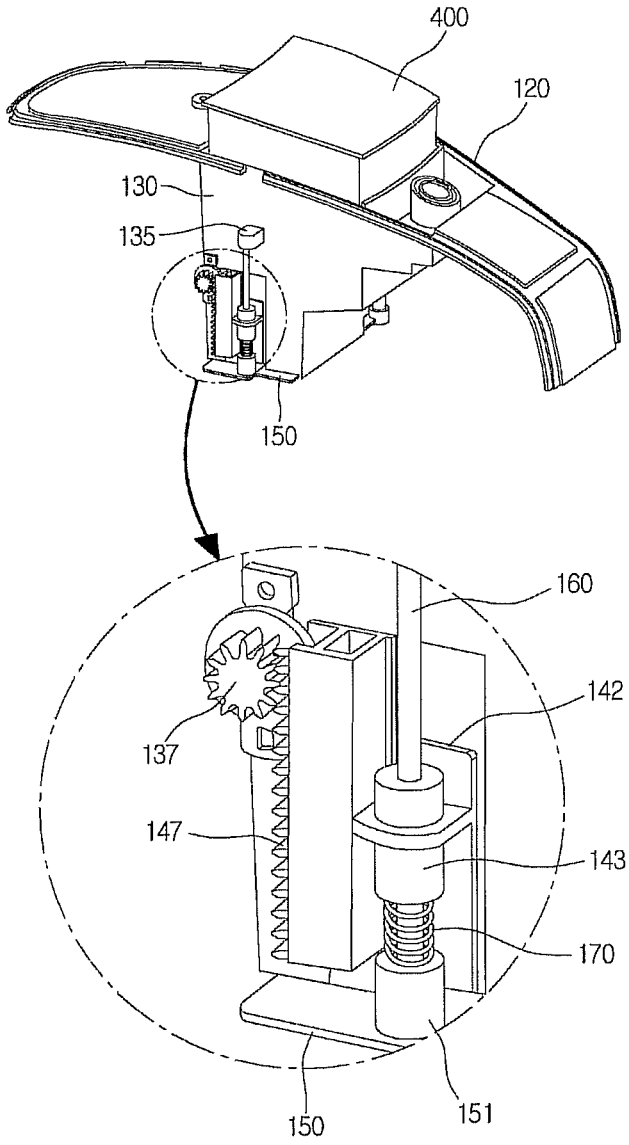
FIG. 5 is a perspective view illustrating a main part of the vacuum cleaner for bedding according to the first embodiment when viewed at angles different from each other.

FIG. 1 is a perspective view of a vacuum cleaner for bedding according to a first embodiment. FIG. 2 is a bottom view of the vacuum cleaner for bedding according to the first embodiment. FIG. 3 is an exploded perspective view illustrating a main part of the vacuum cleaner for bedding according to the first embodiment. FIG. 4 is a perspective view illustrating a main part of the vacuum cleaner for bedding according to the first embodiment. FIG. 5 is a perspective view illustrating a main part of the vacuum cleaner for bedding according to the first embodiment when viewed at angles different from each other.

Referring to FIGS. 1 and 2, a vacuum cleaner 1 for bedding (hereinafter, for convenience of description, referred to as a "vacuum cleaner") includes a casing 10 which defines an outer appearance thereof. The casing 10 has a polyhedral shape with a predetermined inner space therein. The casing 10 includes an upper casing 100 and a base plate 200.

Furthermore, the upper casing 100 has a polyhedral shape with a bottom side opened. The casing 100 will be described later in detail.

The base plate 200 is fixed to a bottom surface of the upper casing 100. A suction hole 210 is defined in the base plate 200. The suction hole 210 serves as a path through which dust are introduced into the casing 100. Here, a portion of the base plate 200 is cut to define the suction hole 210. A roller 220 may be disposed on the base plate 200 to allow the base plate 200 to be moved.

Also, a punching member 230 is disposed on the base plate 200. The punching member 230 is driven by a driving source (not shown) installed inside the casing 100 to punch beddings to be cleaned. The punching member 230 is disposed on a side of the base plate 200 corresponding to a front side of the suction hole 210 with respect to a direction in which the cleaner 1 is moved.

A handle part 300 is disposed on the casing 10. The handle part 300 is a portion which is grasped by a user to utilize the cleaner. Although the handle part 300 is fixed to the upper casing 100 corresponding to an opposite side of the suction hole 210 in FIGS. 1 and 2, the present disclosure is not limited thereto. For example, the handle part 300 may be disposed on various positions. That is, the handle part 300 is disposed at a side opposite to that of the punching member 230 with respect to the suction hole 210.

Also, a duct collection member 400 is accessibly disposed on the casing 10. Substantially, the duct collection member 400 is taken inside/outside the casing 10 through an access opening 121 that will be described later. The dust sucked through the suction hole 210 are collected in the dust collection member 400. At least portion of the duct collection member 400, i.e., a bottom surface of the duct collection member 400 is formed of a metal material. Alternatively, the dust collection member 400 may be formed of a nonmetal material, and a metal member (not shown) may be disposed on the bottom surface of the dust collection member 400.

A display 500 is disposed on the casing 10. The display 500 may output information with respect to an operation of the cleaner 1 or receive a signal with respect to the operation of the cleaner 1 through a touching manner.

Although not shown, a part for moving the dust into the casing 10 through the suction hole 210 may be disposed within the casing 10. For example, a suction device for sucking air containing dust or/and a brush for removing the foreign substance using an adhesive force may be disposed inside the casing 10. The dust sucked or/and attached by the suction device or/and the brush are collected into the dust collection member 400. Specifically, in case where the suction device is installed within the casing 10, the suction hole 210 may be substantially called a suction hole.

Referring to FIGS. 3 to 5, the casing 10 includes first and second parts 110 and 120. The first part 110 may define a portion of the outer appearance of the casing 10, and the second part 120 may define the remaining portion of the outer appearance of the casing 10. Alternatively, the first and second parts 110 and 120 are integrated with each other.

In detail, the first part 110 defines an outer appearance of an edge portion of the casing 10. Also, the edge portion of the first part 110 is fixed to the base plate 200. An opening 111 is defined in the first part 110. A portion of the first part 110 is cut to define the opening 111.

The second part 120 is coupled to the first part 110 and exposed to the outside through the opening 111. The second part 120 has a shape corresponding to that of the opening 111. The access opening 121 is defined in the second part 120. The access opening 121 serves as an entrance through which the dust collection member 400 is taken inside/outside the casing 10.

Also, a receiving member 130 is disposed on a bottom surface of the second part 120. The receiving member 130 may be separately manufactured and fixed to the second part 120 or may be integrated with the second part 120. Also, when the first and second parts 110 and 120 are integrated with each other, the receiving member 130 may be separately manufactured and fixed to the upper casing 100 or may be integrated with the upper casing 100.

The receiving member 130 supports the duct collection member 400 received into the casing 10 through the access opening 121. For example, the receiving member 130 may have a polyhedral shape with a hollow corresponding to the dust collection member 400. Thus, a receiving space 131 for mounting the dust collection member 400 is defined within the receiving member 130. A top surface of the receiving member 130, i.e., an upper side of the receiving space 131 communicates with the outside of the casing 10 through the access opening 121. Also, a bottom surface of the receiving member 130 is opened to vertically move a drawing member 140 that will be described later.

A guide slot 133 is defined in each of both side surfaces of the receiving member 130. The drawing member 140 may be vertically moved through the guide slot 133. Each of both side surfaces of the receiving member 130 is vertically longitudinally cut to define the guide slot 133.

Also, a first shaft support part 135 is disposed on each of both side surfaces of the receiving member 130. The first shaft support part 135 is disposed on an upper portion of each of both side surfaces of the receiving member 130 corresponding to an upper side of the guide slot 133. An upper end of a guide member 160 that will be described later is inserted and fixed to the first shaft support part 135.

Also, a pinion 137 is disposed on one side surface of the receiving member 130. The pinion 137 is gear-coupled to a rack that will be described later.

The drawing member 140 is vertically movably disposed inside the receiving member 130. Substantially, the drawing member 140 moves the dust collection member 400 upward to draw the dust collection member 400 disposed within the receiving space 131. The receiving member 130 may be vertically moved between a position (hereinafter, for convenience of description, referred to as a "take-in position") at which the dust collection member 400 is taken inside the receiving space 131 and a position (hereinafter, for convenience of description, referred to as a "take-out position") at which the dust collection member 400 is taken outside the receiving space 131. In case of the take-in position, for example, a top surface of the dust collection member 400 may be disposed on the same surface as the upper casing 100. Also, in case of the take-out position, at least one portion of the dust collection member 400 may be disposed above the upper casing 100. Substantially, a bottom surface of the dust collection member 400 is seated on a top surface of the drawing member 140. Also, first and second flanges 141 and 142 are disposed on both side ends of the receiving member 130, respectively.

In FIG. 3, the first flange 141 is disposed on a left end of the receiving member 130. The first flange 141 is stepped upward with respect to the receiving member 130 and passes through the guide slot 133 to extend to the outside of the receiving space 131. A shaft through part 143 is disposed in the first flange 141. The guide member 160 passes through the shaft through part 143. Also, a locking hook 145 is disposed on the first flange 141. The locking hook 145 is selectively engaged with a locking latch 153 that will be described later. The shaft through part 143 is coaxially vertically disposed with respect to one of the first shaft support parts 135.

In FIG. 3, the second flange 142 is disposed on a right end of the receiving member 130 corresponding to an opposite side of the first flange 141. A shaft through part 143 through which the guide member 160 passes is disposed on the second flange 142, like the first flange 141. The shaft through part 143 is coaxially vertically disposed with respect to the other one of the first shaft support parts 135.

Also, a rack 147 is disposed on the second flange 142. The rack 147 is gear-coupled to the pinion 137. The rack 147 is vertically longitudinally disposed on the second flange 142. When the drawing member 140 is vertically moved with respect to the receiving member 130, the pinion 137 is rotated while the rack 147 is moved upward. Thus, the rack 147 and the pinion 137 give a frictional force against the duct collection member 130 in a direction opposite to the moving direction of the drawing member 140. Specifically, the rack 147 and the pinion 137 give a frictional force in a direction opposite to that of an elastic force of an elastic member 170 (that will be described later) applied to the drawing member 140. Thus, the pinion 137 and the rack 147 may control a moving speed of the drawing member 140 with respect to the receiving member 130, substantially, a speed for drawing the dust collection member 400 to the outside of the receiving member 130. Thus, the pinion 137 and the rack 147 may be called damping devices.

A magnet 149 is disposed on the drawing member 140. The magnet 149 may function as a support for firmly fixing the dust collection member 400 to the drawing member 140. That is, the magnet 149 generates a magnetic force which is gravitationally applied to the dust collection member 400 formed of a metal material or the metal member disposed in the dust collection member 400 formed of a nonmetal material. The magnet 149 protrudes downward from a bottom surface of the drawing member 140.

A support member 150 is disposed on the bottom surface of the receiving member 130. The support member 150 is fixed to the bottom surface of the receiving member 130 to allow the drawing member 140 to be vertically movably supported with respect to the receiving member 130. Here, both ends of the support member 150 further extend toward both sides of the receiving member 130. Also, the support member 150 may shield the opened bottom surface of the receiving member 130. Alternatively, when the support member 150 and the receiving member 130 are integrated with each other, the receiving member 130 may have a hollow polyhedral shape with a top surface opened.

A second shaft support part 151 is disposed on each of both ends of the support member 150. A lower end of the guide member 160 is inserted and supported into/by the second shaft support part 151. Thus, the second shaft support part 151 is coaxially vertically disposed with respect to the first shaft support part 135 and the shaft through part 143.

Also, in FIG. 3, the locking latch 153 is disposed on a left end of the support member 150. The locking latch 153 is selectively engaged with the locking hook 145. That is, when the dust collection member 400 is disposed at the take-in position, the locking latch 153 and the locking hook 145 are engaged with each other. For example, when an external force is applied in a direction in which the locking hook 145 is inserted into the locking latch 153 in a state where the engagement between the locking hook 145 and the locking latch 153 is released, the locking latch 153 and the locking hook 145 are engaged and locked against each other. On the other hand, when an external force is applied in the direction in which the locking hook 145 is inserted into the locking latch 153 in a state where the locking hook 145 and the locking latch 153 are locked against each other, the engagement between the locking hook 145 and the locking latch 153 is released. Thus, the locking hook 145 and the locking latch 153 may be called locking devices.

A magnet seating opening 155 is defined in the support member 150. A portion of the support member 150 is cut to define the magnet seating opening 155. Also, when the dust collection member 400 is disposed at the take-in position, the magnet 149 is disposed in the magnet seating opening 155.

Also, the vertical movement of the drawing member 140 with respect to the receiving member 130 is guided by two guide members 160. The guide member 160 passes through the shaft through part 143, and both ends of the guide member 160 are respectively inserted into the first and second shaft support parts 135 and 151.

The elastic member 170 is disposed between the drawing member 140 and the support member 150. A coil spring through which the guide member 160 passes may be used as the elastic member 170. Substantially, upper and lower ends of the elastic member 170 contact the shaft through part 143 and the second shaft support part 151, respectively. Alternatively, the upper and lower ends of the elastic member 170 may be supported by the first and second flanges 141 and 142 and both ends of the top surface of the support member 150, respectively.

The elastic member 170 gives an elastic force to the drawing member 140 to allow the drawing member 140 to be moved upward with respect to the receiving member 130. That is to say, the elastic member 170 may give an elastic force to the drawing member 140 to allow the dust collection member 400 to be disposed at the take-out position. Thus, when the locking device, i.e., the engagement between the locking hook 145 and the locking latch is released, the drawing member 140 is moved upward with respect to the receiving member 130 by the elastic force of the elastic member 170. Thus, the dust collection member 400 is disposed at the take-out position. However, in the state where the locking hook 145 and the locking latch 153 are locked, since the drawing member 140 is not moved upward with respect to the receiving member 130 in spite of the elastic force of the elastic member 170, the dust collection member 400 may be disposed at the take-in position.

The drawing member 140, the guide member 160, and the elastic member 170 may substantially draw the dust collection member 40 to the outside of the casing 100. Thus, the drawing member 140, the guide member 160, and the elastic member 170 may be called a drawing device.

Hereinafter, an assess process of the dust collection member of the vacuum cleaner for bedding according to the first embodiment will be described in detail with reference to the accompanying drawings.

Figure 6:
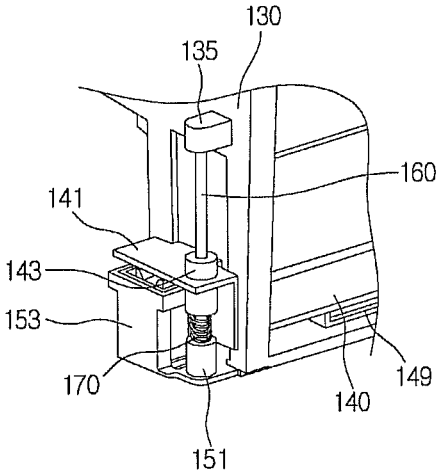
FIGS. 6 and 7 are views illustrating an access process of a duct collection member of the vacuum cleaner for bedding according to the first embodiment.
Figure 7:
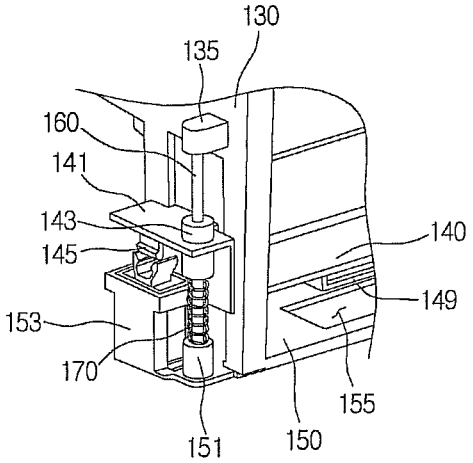

FIGS. 6 and 7 are views illustrating an access process of the duct collection member of the vacuum cleaner for bedding according to the first embodiment.

Referring to FIG. 6, in the state where the dust collection member 400 is received into the receiving space 131, i.e., the dust collection member 400 is disposed at the take-in position, the locking hook 145 and the locking latch 153 are engaged and locked with/against each other. Also, in the state where the drawing member 140 is moved downward with respect to the receiving member 130, the magnet 149 is inserted into the magnet seating opening 155. Thus, the drawing member 140 is not horizontally moved with respect to the support member 150.

Here, the elastic member 170 is in a substantially pressed state by the drawing member and the support member 150. However, as described above, since the locking hook 145 and the locking latch 153 are locked against each other, the drawing member 140 is not moved upward with respect to the support member in spite of the elastic force applied from the elastic member 170. Thus, the dust collection member 400 may be maintained at the take-in position. Then, to draw the dust collection member 400 to the outside of the receiving space 131, an external force may be applied in a direction in which the locking hook 145 is inserted into the locking latch 153. For example, when the duct collection member 400 is pressed downward, the locking between the locking hook 145 and the locking latch 153 is released.

However, as shown in FIG. 7, since the elastic force of the elastic member 170 is being applied to the drawing member 140, the drawing member 140 is moved upward with respect to the support member 150. Thus, the dust collection member 400 is moved from the take-in position to the take-out position through the access opening 121. Also, the upward movement of the drawing member 140 with respect to the support member 150 is guided by the guide member 160.

When the drawing member 140 is moved upward with respect to the support member 150 by the elastic force of the elastic member 170, the rack 147 and the pinion 137 are moved upward in a state where the rack 147 and the pinion 137 are gear-coupled to each other. Thus, the upward moving speed of the drawing member 140 due to the elastic force of the elastic member 170, substantially, the drawal speed of the dust collection member 400 may be restricted.

Hereinafter, a vacuum cleaner for bedding according to a second embodiment will be described in detail with reference to the accompanying drawings.

Figure 8:
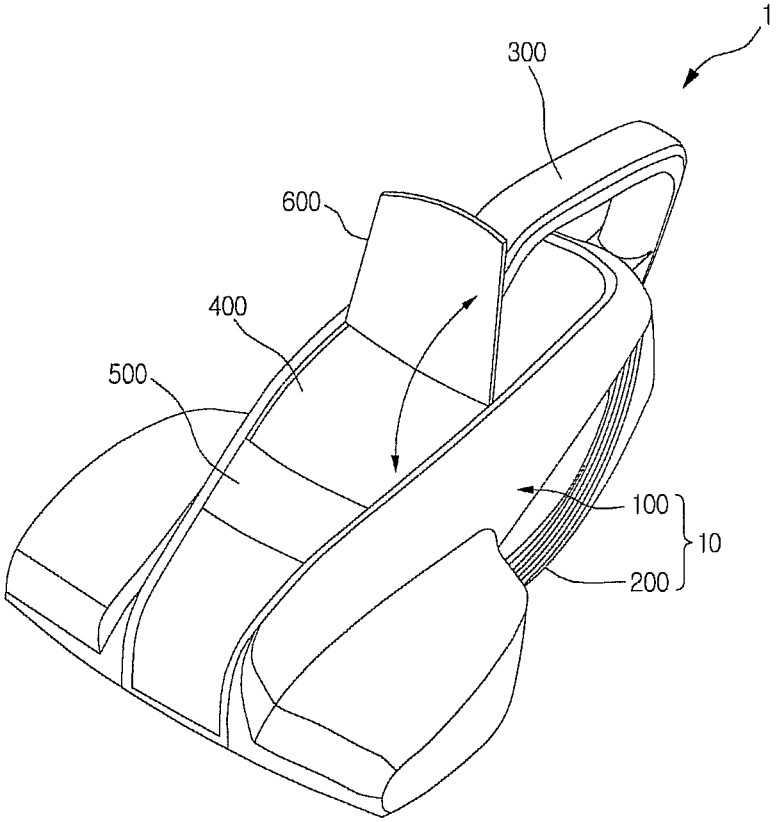
FIG. 8 is a perspective view of a vacuum cleaner for bedding according to a second embodiment.

FIG. 8 is a perspective view of a vacuum cleaner for bedding according to a second embodiment. In the current embodiment, the same elements as those of the first embodiment are denoted from the reference numerals of FIGS. 1 to 7, and also descriptions of the same elements will be omitted herein.

Referring to FIG. 8, in the current embodiment, an access opening 121 is opened or closed by a cover 600. For example, the cover 600 may be rotatably disposed on a casing 10, substantially, an upper casing 100. Alternatively, the cover 600 may be slidably disposed with respect to the upper case 100. Although not shown, an additional locking device for preventing the cover 600 from being voluntarily rotated with respect to the upper casing 100 in a state where the cover 600 covers the access opening 121. For example, the additional locking device may include the same constitution as those of the locking hook 145 and the locking latch 153 which are previously described in the first embodiment. Thus, in the current embodiment, a dust collection member 400 may be maintained at a take-in position by two locking devices.

Hereinafter, a vacuum cleaner for bedding according to a third embodiment will be described in detail with reference to the accompanying drawings.

Figure 9:
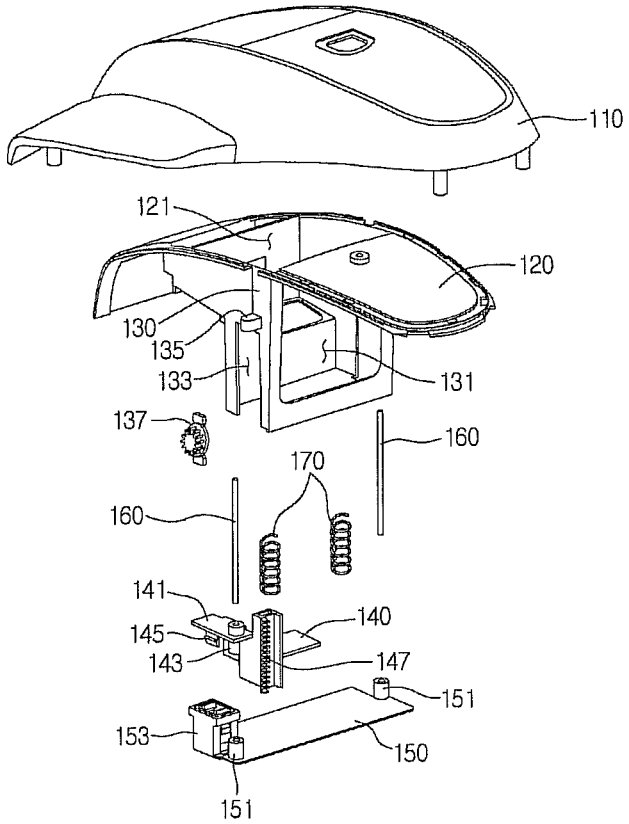
FIG. 9 is an exploded perspective view illustrating a main part of a vacuum cleaner for bedding according to a third embodiment.
Figure 10:
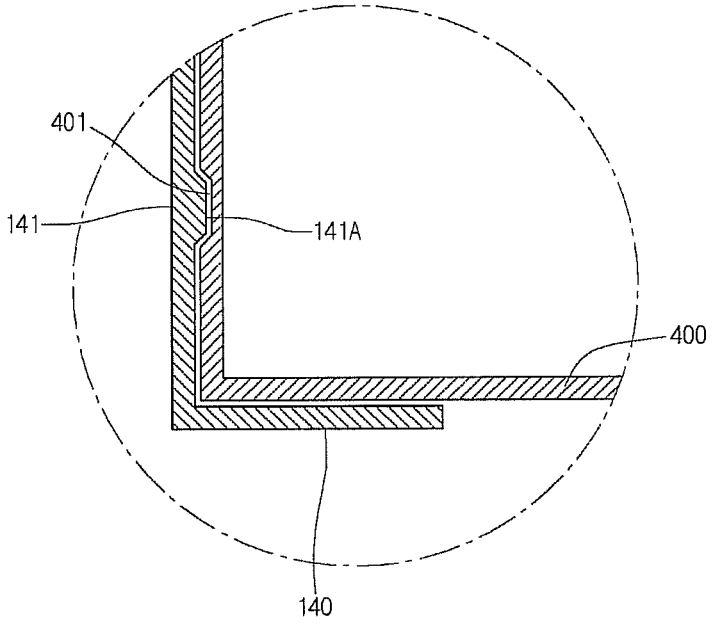
FIG. 10 is a sectional view illustrating a main part of the vacuum cleaner for bedding according to the third embodiment.

FIG. 9 is an exploded perspective view illustrating a main part of a vacuum cleaner for bedding according to a third embodiment. FIG. 10 is a sectional view illustrating a main part the vacuum cleaner for bedding according to the third embodiment. In the current embodiment, the same elements as those of the first embodiment are denoted from the reference numerals of FIGS. 1 to 7, and also descriptions of the same elements will be omitted herein.

Referring to FIGS. 9 and 10, in the current embodiment, a portion of a drawing member 140 including a second flange 142 is removed. That is, in the current embodiment, the drawing member 140 supports a portion of a bottom surface of the dust collection member 400. Also, the drawing member 140 contacts a portion of a side surface of the dust collection member 400. A pinion 137 is disposed on a first flange 141, and a rack 147 is disposed on one side surface of a receiving member 130 corresponding to the pinion 137.

Also, in the current embodiment, a hook projection 141A is disposed on a side of the drawing member 140, i.e., the first flange 141. The hook projection 141A protrudes from an inner side surface of the first flange 141. Also, a hook groove 401 is defined in one side surface of the dust collection member 400. The hook groove 401 has a shape corresponding to that of the hook projection 141A. A portion of the one side surface of the dust collection member 400 is recessed to define the hook groove 401. When a bottom surface of the dust collection member 400 is supported by a top surface of the drawing member 140, the hook projection 141*a* is seated on the hook groove 401.

The dust collection member 400 has a reversed trapezoidal shape in section. The receiving member 130, i.e., a receiving space 131 has a sectional shape corresponding to that of the dust collection member 400 in a state where the dust collection member 400 is disposed at a take-in position. Here, a distance between both side surfaces of the receiving member 130 and both side surfaces of the dust collection member 400 may be equal to that spaced by at least protruding thickness of the hook projection 141A.

When the dust collection member 400 is supported by the drawing member 140, the hook projection 141A is seated on the hook groove 401. In this state, when the dust collection member 400 is disposed at the take-in position, a left and right moving distance of the dust collection member 400 is restricted to a distance less than the thickness of the hook projection 141A. Thus, in the state where the dust collection member 400 is supported by the drawing member 140, the dust collection member 400 is not voluntarily moved upward.

However, when the dust collection member 400 is disposed at the take-out position in the state where the dust collection member 400 is supported by the drawing member 140, only a portion of the dust collection member 400 is received outside the receiving space 131. Thus, the left and right moving distance of the dust collection member 400 increases to excess the thickness of the hook projection 141A. As a result, when the dust collection member 400 is moved in left and right directions, the dust collection member 400 may be easily separated from the drawing member 140.

It should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

In the above-described embodiments, although the cleaner having a relatively small size is described as an example, the technical spirits of the present disclosure may be applied to various cleaners including a dust collection member for collecting dust. Also, the technical spirits of the present disclosure may be applied to automatic cleaners as wall as manual cleaners.

Also, in the above-described embodiments, the drawing member is vertically moved to draw the dust collection member. However, the drawing member may be moved in front and rear directions to draw the dust collection member. That is, the drawing member may be linearly moved to draw the dust collection member.

Also, in the above-described embodiments, the pinion is disposed on the receiving member, and the rack is disposed on the drawing member. However, the pinion may be disposed on the drawing member, and the rack may be disposed on the receiving member.

In the above-described embodiments, the dust collection member is formed of a metal material, and the metal member is disposed on the dust collection member. Also, the magnet is disposed on the drawing member. However, the magnet may be disposed on the dust collection member, and at least one portion of the drawing member may be formed of a metal material.

What is claimed is:

1. A cleaner, comprising:

a casing having a suction hole through which dust is sucked, the casing including a receiver that defines a receiving space;

a suction device to suck air containing the dust through the suction hole;

a dust collector disposed accessible in the receiving space, wherein the dust collector collects the dust sucked into the casing by the suction device;

a drawing member movably disposed in a linear direction with respect to the receiver to draw the dust collector to an outside of the casing so that at least a portion of the dust collector is drawn to the outside of the casing;

a support fixed to the receiver to support the drawing member so that the drawing member is movable in the linear direction with respect to the receiver;

an elastic member to apply an elastic force to the drawing member in a second direction in which the dust collector is drawn to the outside of the casing;

a lock that selectively allows a linear movement of the drawing member with respect to the receiving space, wherein the dust collector is received in the receiving space in a first direction and is mounted to the receiver in the first direction, and wherein when the dust collector is pressed in the first direction in a state in which the dust collector is received in the receiving space, the drawing member automatically pushes and draws the dust collector from the receiving space by lifting the dust collector in the second direction, which is a reverse direction of the first direction, by the elastic force applied by the elastic member; and a guide that guides the linear movement of the drawing member with respect to the receiver, wherein both ends of the guide pass through the drawing member and are supported by the receiver and the support, respectively.

2. The cleaner according to claim 1, wherein the receiver has a hollow polyhedral shape having an open bottom side, and wherein the support shields the bottom side of the support.

3. The cleaner according to claim 1, wherein the drawing member is disposed within the receiving space, wherein a guide slot through which a portion of the drawing member extends to an outside of the receiving space is defined in each of both side surfaces of the receiver, and wherein the elastic member is pressed by a portion of the drawing member that extends to the outside of the receiving space through the guide slot.

4. The cleaner according to claim 1, wherein a magnet is disposed on one of the dust collector or the drawing member, and wherein a metal member that contacts the magnet by a magnetic force of the magnet is disposed on the other of the dust collector or the drawing member.

5. The cleaner according to claim 1, wherein a coil spring having a first end that contracts the drawing member and a second end that contracts the support is used as the elastic member.

6. The cleaner according to claim 1, wherein the lock includes:

a locking hook disposed on one of the drawing member or the support; and a locking latch disposed on the other of the drawing member or the support, wherein the locking latch is selectively engaged with the locking hook, and wherein the locking hook and the locking latch are released in a state in which the locking hook and the locking latch are locked against each other or locked in a state in which the locking hook and the locking latch are released from each other by an external force in a direction in which the dust collector is received into the receiving space.

7. The cleaner according to claim 1, wherein the elastic member surrounds the guide and is selectively pressed by the drawing member and the support.

8. A cleaner, comprising:

a casing having a suction hole through which dust is sucked, the casing including a receiver that defines a receiving space;

a suction device to suck air containing the dust through the suction hole;

a dust collector disposed accessible in the receiving space, wherein the dust collector collects the dust sucked into the casing by the suction device;

a drawing member movably disposed in a linear direction with respect to the receiver to draw the dust collector to an outside of the casing so that at least a portion of the dust collector is drawn to the outside of the casing;

a support fixed to the receiver to support the drawing member so that the drawing member is movable in the linear direction with respect to the receiver;

an elastic member to apply an elastic force to the drawing member in a second direction in which the dust collector is drawn to the outside of the casing;

a lock that selectively allows a linear movement of the drawing member with respect to the receiving space, wherein the dust collector is received in the receiving space in a first direction and is mounted to the receiver in the first direction, and wherein when the dust collector is pressed in the first direction in a state in which the dust collector is received in the receiving space the drawing member automatically pushes and draws the dust collector from the receiving space by lifting the dust collector in the second direction, which is a reverse direction of the first direction, by the elastic force applied by the elastic member; and a damper that restricts a linear moving speed of the drawing member with respect to the receiver, wherein the damper generates a frictional force between the receiver and the drawing member in a direction opposite to the second direction in which at least the dust collector is drawn to the outside of the receiver.

9. The cleaner according to claim 8, wherein the damper includes:

a pinion disposed on one of the receiver or the drawing member; and a rack disposed on the other of the receiver or the drawing member, and wherein the rack is gear-coupled to the pinion.

* * * * *